US012030540B2

(12) United States Patent
Dubov

(10) Patent No.: US 12,030,540 B2
(45) Date of Patent: Jul. 9, 2024

(54) LOCAL OPERATION SYSTEM

(71) Applicant: ISRAEL RAILWAYS LTD, Lod (IL)

(72) Inventor: Alexander Dubov, Nesher (IL)

(73) Assignee: ISRAEL RAILWAYS LTD., Lod (IL)

( * ) Notice: Subject to any disclaimer, the term of this patent is extended or adjusted under 35 U.S.C. 154(b) by 973 days.

(21) Appl. No.: 17/017,525

(22) Filed: Sep. 10, 2020

(65) Prior Publication Data

US 2020/0406945 A1 Dec. 31, 2020

Related U.S. Application Data

(63) Continuation of application No. PCT/IL2019/050245, filed on Mar. 6, 2019.

(30) Foreign Application Priority Data

Mar. 18, 2018 (IL) ..... 258182

(51) Int. Cl.

| | |
|---|---|
| ***B61L 25/06*** | (2006.01) |
| ***B61L 5/18*** | (2006.01) |
| ***B61L 17/02*** | (2006.01) |
| ***B61L 23/04*** | (2006.01) |

(52) U.S. Cl.

CPC ..... *B61L 25/06* (2013.01); *B61L 5/18* (2013.01); *B61L 17/023* (2013.01); *B61L 23/041* (2013.01); *B61L 2207/02* (2013.01)

(58) Field of Classification Search

CPC ..... B61L 5/18; B61L 17/023; B61L 23/041; B61L 25/06; B61L 2207/02

See application file for complete search history.

(56) References Cited

U.S. PATENT DOCUMENTS

2017/0106885 A1* 4/2017 Singh ..... B61L 23/042

FOREIGN PATENT DOCUMENTS

| | | |
|---|---|---|
| CN | 203616631 U | 5/2014 |
| DE | 4302377 A1 | 8/1994 |
| JP | 2004161071 A | 6/2004 |

OTHER PUBLICATIONS

International Preliminary Report of Patentability issued by the International Searching Authority in corresponding International Patent Application No. PCT/ IL2019/050245, dated Mar. 8, 2020.

International Search Report issued by the International Searching Authority in corresponding International Patent Application No. PCT/IL2019/050245, dated Jun. 27, 2019.

* cited by examiner

*Primary Examiner* — Robert J McCarry, Jr.
(74) *Attorney, Agent, or Firm* — ArentFox Schiff LLP

(57) ABSTRACT

The object of the present invention is to provide a system for operating a marshalling yard in a more efficient and time saving way, by avoiding unnecessary procedures of preparation, usually done manually by mechanical means only, and turn it into an advanced technological facility.

7 Claims, 11 Drawing Sheets

LOCAL OPERATION SYSTEM

CROSS-REFERENCE TO RELATED APPLICATIONS

This application is a Continuation of PCT application No. PCT/IL2019/050245, filed on Mar. 6, 2019, which claims priority to Israeli Patent Application No. 258182, filed on Mar. 18, 2018. The disclosure of the priority application is incorporated in its entirety herein by reference.

FIELD OF THE INVENTION

The object of the present invention is to provide a system for operating a marshalling yard in a safer, more efficient and time saving way, by avoiding unnecessary procedures of preparation, usually done manually by mechanical means only, and turn it into an advanced operational technological safe facility.

BACKGROUND OF THE INVENTION AND PRIOR ART

Marshalling yards are one of the corner stones in the railway network. The railway world consists of many zones that may be attributed to zones called "Marshaling Yards" like depot areas, workshops areas, parking areas, preparation yards, marshaling yards in private plants, and more. In those yards, numerous operational train tracks are used to move the trains to different locations in each yard for different purposes such as fueling, maintenance, coupling and uncoupling wagons etc. Since the trains and/or the single locomotives traffic moves in a very low speed and low frequency, the switching points are operated manually and mechanically. Whereas routine movement of trains is automatically programmed and fixed for long distances, the traffic movements of trains and/or single locomotives in marshaling yards is neither fixed nor predictable and has, so far, been navigated manually since there was no automatic system that could monitor ad-hoc traffic movements.

This method of operation causes a significant slowdown in route preparation, lack of control specifically on the switching points, and on the train route as a whole, it causes decrease in safety level of locomotive movements in the yard and significantly increases the number of employees.

Manual work in marshaling yards is among the most dangerous ones within the railway field. Many cuts of wagons are moving through the marshaling yard with various speeds during split-up activities; top attention and experience are required from the persons working in marshaling yard. Therefore, there is an effort to reduce manual work in marshaling yard as much as possible while increasing, operational effectiveness and safety.

The new system introduces a safer and more efficient and time saving way, of operating marshaling yards by avoiding unnecessary procedures of route preparation performed by manual mechanical means only and turns it into an advanced technological safe facility.

To date there are 2 alternatives for administrating movable objects (locomotives or railway cars) in marshaling yards: either controlling by signaling systems or controlling by manpower and radio/acoustic communication without signaling systems. The new introduced system aims to improve the latter but also include the orientation of a signaling system.

The novelty introduced in the new system concerns the signaling system.

To date, identification of movable objects in track areas is monitored by two identification systems: either track circuit or axle counter. Both systems are very expensive and require installation of massive instrumentation and enchainment along the tracks. Another disadvantage of those systems (disadvantage related to marshal yards only) is their ability to solely identify train movable objects, human factors or other obstacles around the track zone.

The new system uses laser scanners that enables credible identification of train movable objects, human factors and other detected obstacles in track zone, thus increasing the safety level of marshaling yards. The new system offers a simpler and cheaper solution compared to the known ones and combines several means that normally are not part of trains signaling systems.

To date, in order to give the train driver an indication that the route is locked only for him, traffic signs are used. Furthermore, point indicators are installed along the switch points giving the train driver limited indication as to the switch conditions and in one direction only. All such systems do not give the driver any indication as to blocked tracks along the route, only at the starting drive route.

The use of laser scanners for alerting of blocked tracks section, between tracks direction led direction light element that guide the driver along the whole route, and video cameras that cover the whole route (inside the marshalling yard)—significantly improves the needed information provided to the driver and/or operator in marshaling yards.

SUMMARY OF THE INVENTION

The new system is a remote controlled, guiding and monitoring operational system that electronically operates and monitors the switch points as well as the route inside a marshaling yard and enables controlling it by coverage of laser scanners and high resolution digital video cameras.

The system comprises the following elements: Central computer and its I/O peripherals, power supply control cabinets, remotely controlled electric motors that operate (moves) the switch points, high resolution digital video cameras, laser scanners, automatically operated Led direction light element installed between tracks for visual indication to the driver along the route, cables and secured digital transmission.

The system may serve one or more control zones.

DETAILED DESCRIPTION OF THE PREFERRED EMBODIMENTS

The new system is a remote control and monitoring system that electronically operates the switch points, monitors it and enables control of marshaling yards by coverage of laser scanners, high resolution digital video cameras, automatically operated Led direction light element installed between tracks for visual indication to the driver along the route, cables and secured digital transmission.

Figure 1:
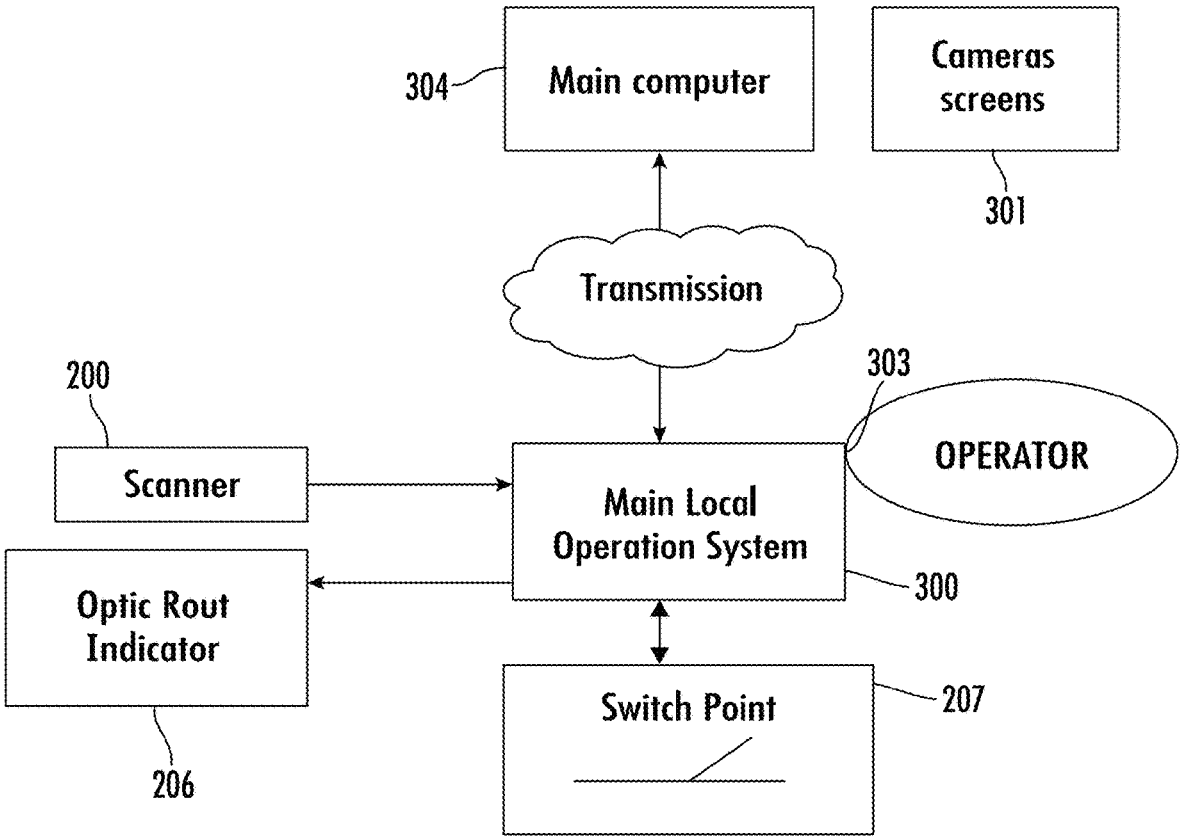
FIG. 1 shows a schematic plan of the system
Figure 9:
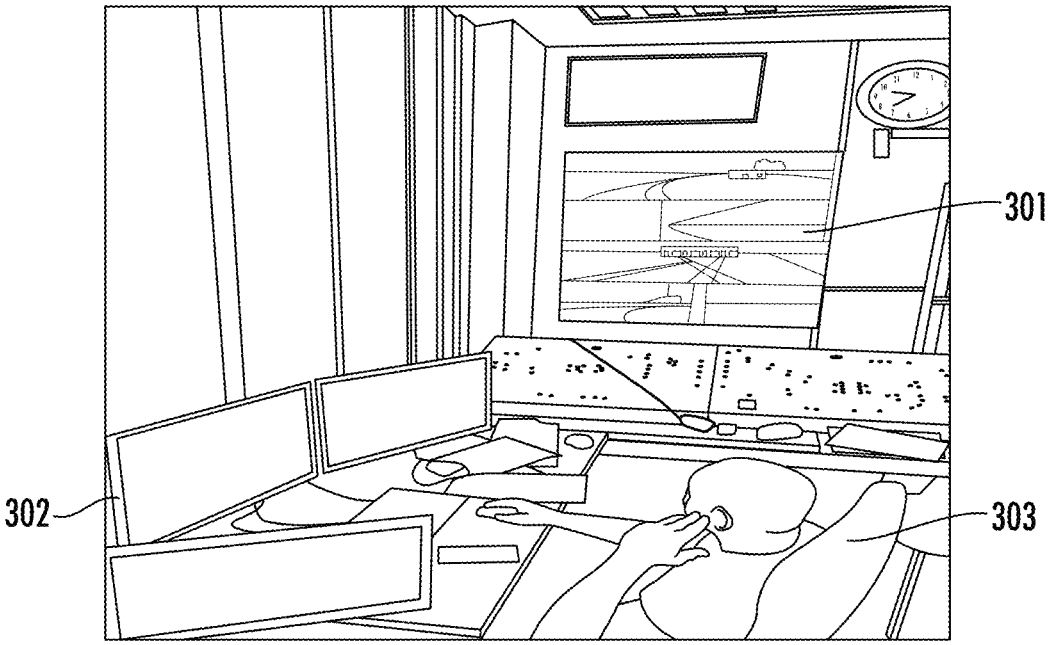
FIG. 9 is an image of control center.

As may be seen in the schematic plan of the system (FIG. 1), Operator 303 is operating the system from local control station 300. Several high definition digital cameras are installed along the tracks to and from marshaling yard in different zones enabling operator 303 the visual observation via camera displays 301 of all the switch points 207, as shown in FIG. 9.

A main computer 304 operates the system and may be located anywhere. The system's components are connected by digital transmission that may control operations from unlimited locations.

The main local operation system comprises, a power supply system, programmed controllers, relays, motors and various electronic devices.

Figure 4:
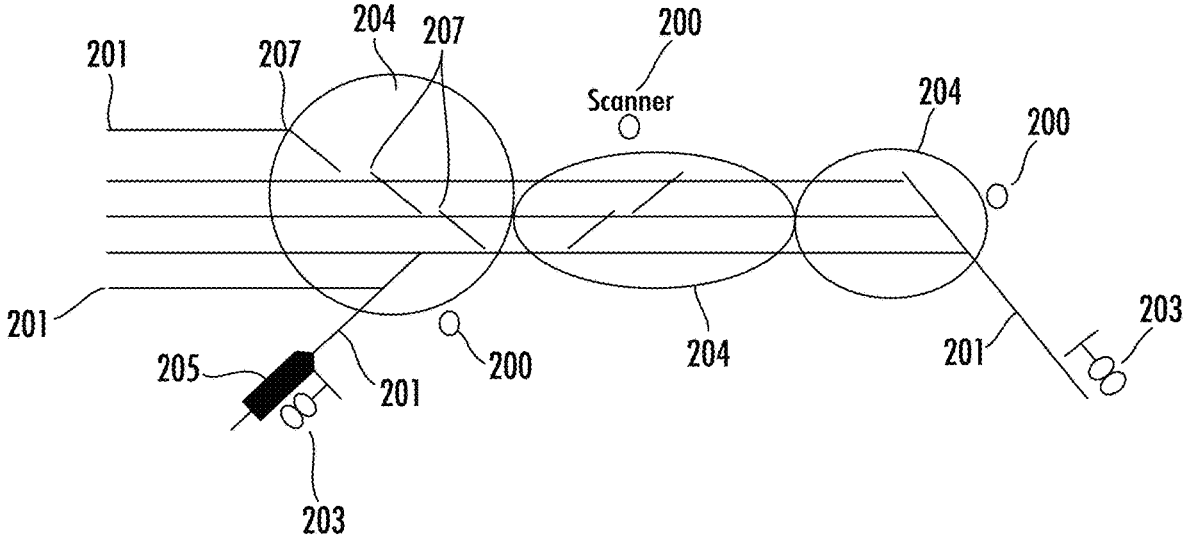
FIG. 4 shows an illustration of laser scanners and its beams installed alongside the tracks.
Figure 5:
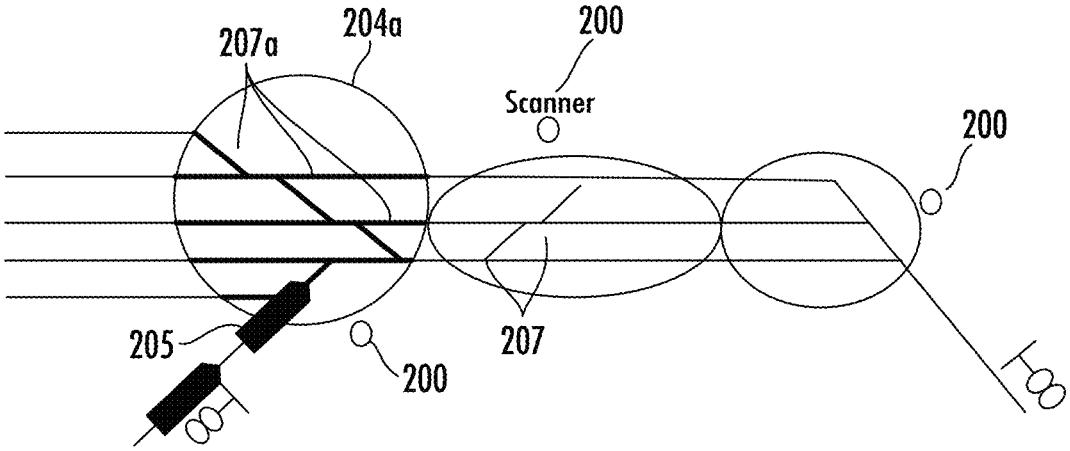
FIG. 5 shows an illustration of a movable object entering a laser scanner beam stage 1.
Figure 6:
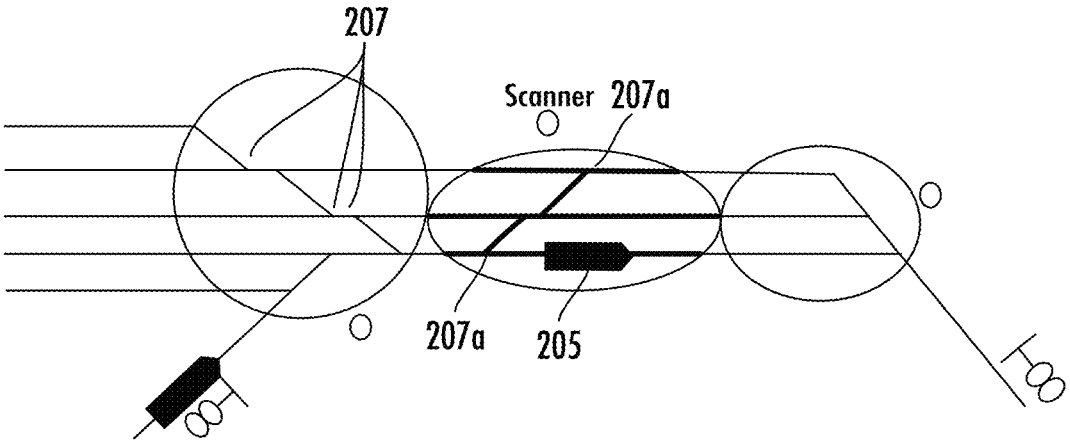
FIG. 6 shows an illustration of a movable object entering a laser scanner beam stage 2.
Figure 7:
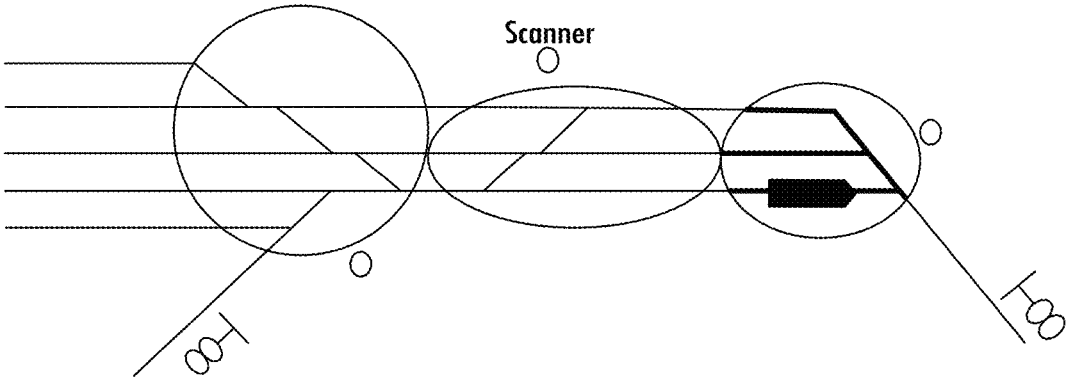
FIG. 7 shows an illustration of a movable object entering a laser scanner beam stage 3.
Figure 8:
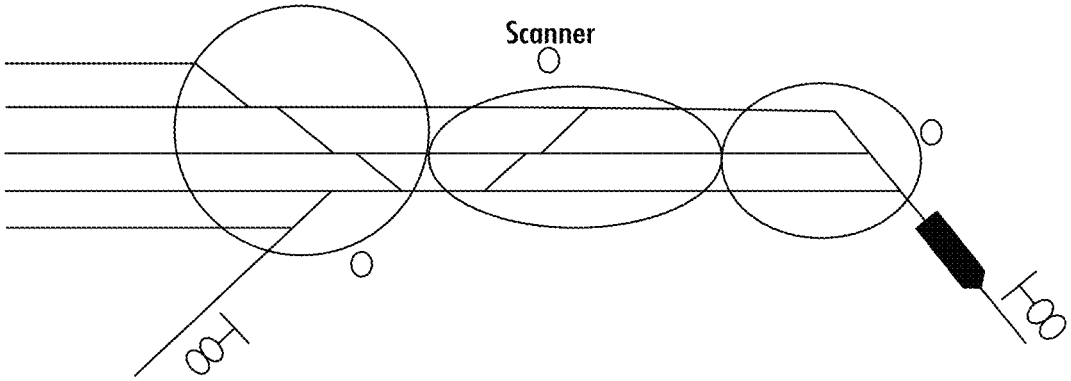
FIG. 8 shows an illustration of a movable object leaving the laser scanner beam.

As may be seen in FIG. 4, Laser scanners 200 are installed parallel to tracks 201 in predefined locations so that laser scanner beams 204 covers the whole control area overlapping each other in switch points 207.

Figure 3:
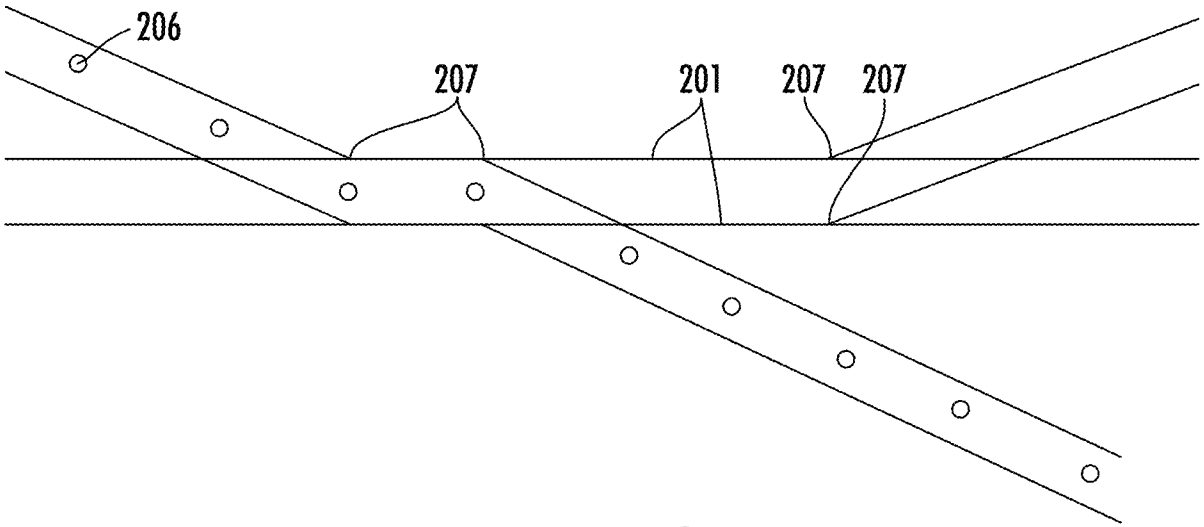
FIG. 3 shows the direction light element installed between tracks for visual indication to the driver along the route.
Figure 10:
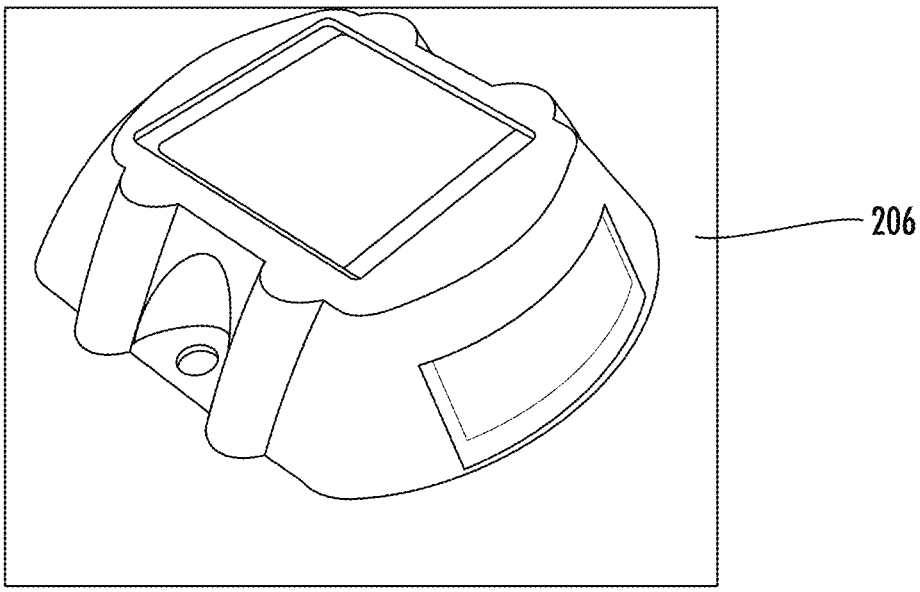
FIG. 10 is an image of a direction light element to be installed between tracks along the route for visual indication to the locomotive driver.
Figure 11:
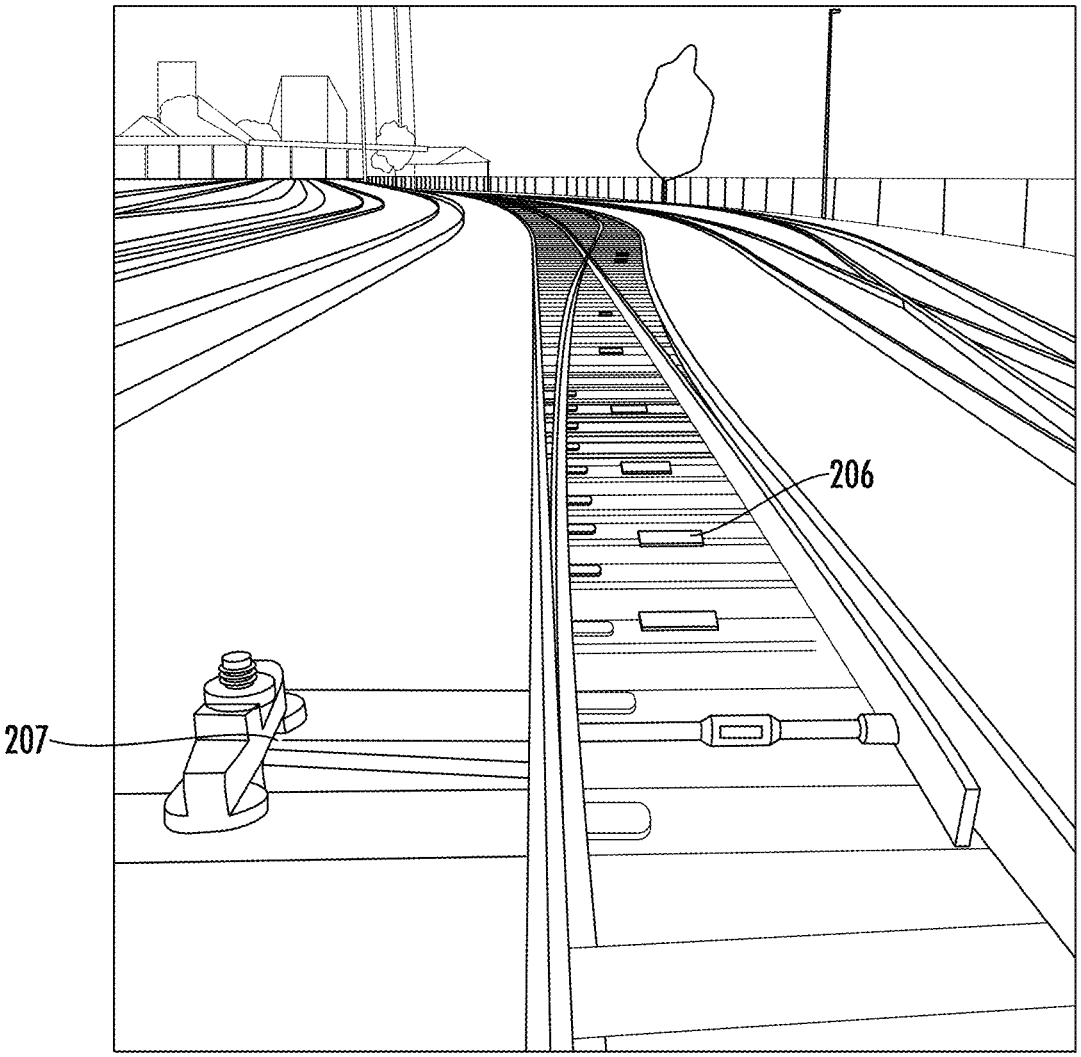
FIG. 11 is an illustration of direction light element for route Indicators installed on tracks.

Direction light element 206 (shown in FIG. 10) are installed between tracks 201 providing a visual indication to the driver of locking position of the track and a safe route direction, (FIG. 3) (also showing in FIG. 11).

Figure 2:
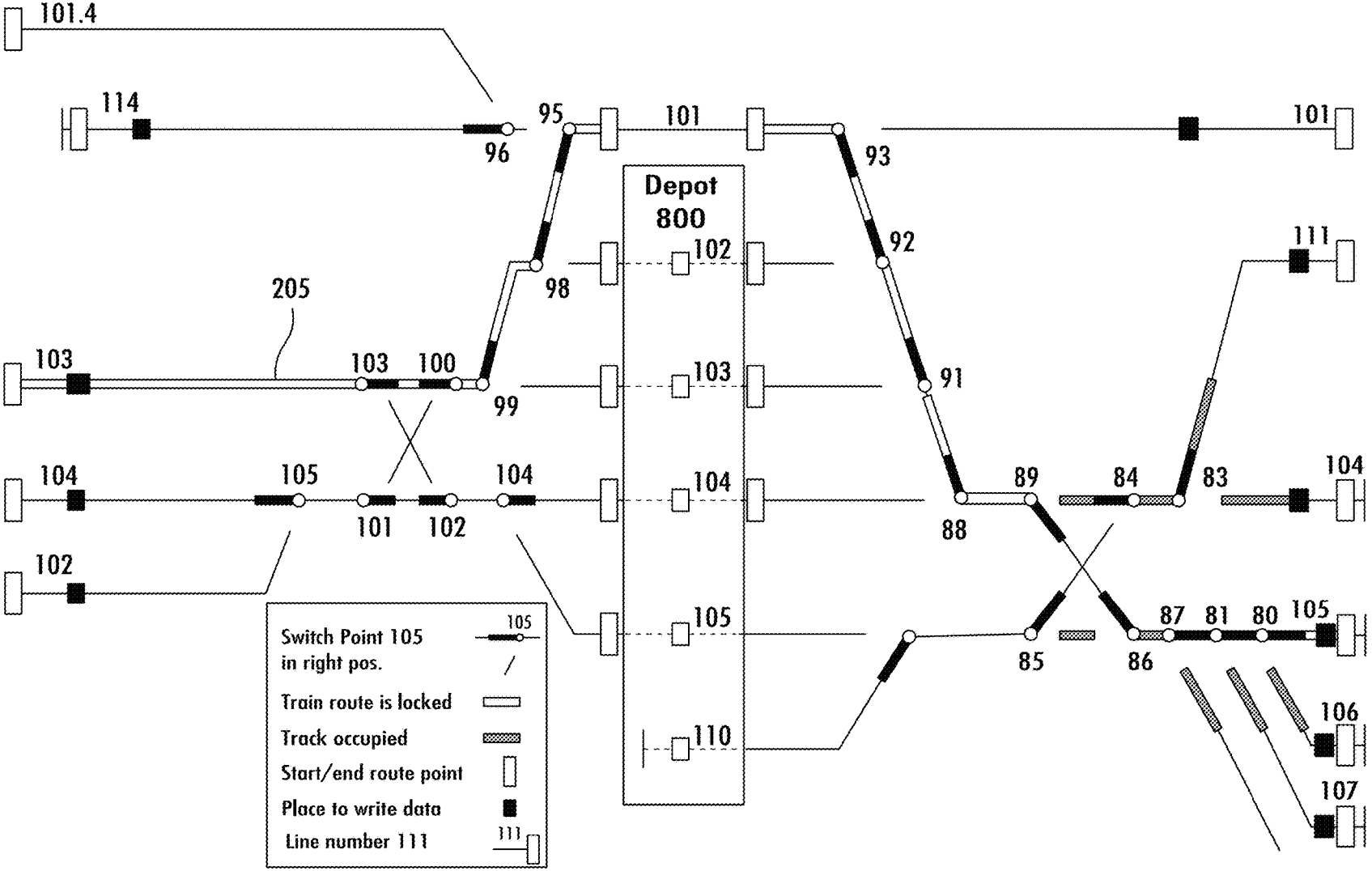
FIG. 2 shows a live control screen of the operation system.

As may be seen in FIG. 2 (and FIG. 9) central computer screen 302 is monitored by operator 303. When operator receives a request to let a locomotive or other train vehicle into or out of a marshaling yard 205 (FIG. 2), he performs a visual check of the camera displays (FIG. 9) ensuring that switch points 207 (FIG. 4) are clear of other movable object, human factor or any other obstacle and performs a visual check on main computer screen ensuring that all switch points 207 (FIG. 4) monitored by laser scanners (200) show clear position. Operator also gets from the central computer (203) indications of intention of movable objects, (a locomotive or other train vehicle) 205 to enter or exit from the nationwide main interlocking system.

When all laser scanners within control area are showing "clear", route may be prepared in the usual manner. Meaning, planning the schedule routes of the trains. If at least one scanner indicates "in use position", the system enables the preparation of the route in emergency only and for no longer than 30 seconds. Preparation of the route in these instances means, re-routing train traffic to alternative routes.

Main computer 304 performs the preparation of trip route.

Main computer 304 performs the locking of route. Once the route is locked, switch points 207 at control area are not movable.

When the route is locked visual route indicators 206 are alight along the route trip, indicating to the driver that route is locked for him and pointing out to him the direction of the trip.

The driver gets confirmation to move via radio/acoustic communications.

When operator ensures via cameras display 301 and main computer screen 302 that the entire movable object had exited switch points 207 zone, operator releases the route and the system returns to start point.

FIG. 2 demonstrates a live situation where movable object 205 gets into a marshaling yard via track 103 advancing through points 099, 098 & 095 to maintenance area 800. The green light indication on main computer screen shows the clear route and the moving of movable object 205 on route from track 103-101. When movable object 205 leaves maintenance area 800 toward track 105 all routes leading to movable object 205's route (points 080,081,082, etc) show red indication, meaning that all switch points on route to track 105 are unmovable unless in emergency.

What is claimed is:

1. A remote control and monitoring system that electronically monitors the switch points of railway tracks in marshaling yards, working areas and maintenance areas, tangential to the interlocking system, comprising:

a central computer operating the system via secured digital transmission; and a power supply system, cables, programmed controllers, relays, electric motors for change of switch points directions and other electronic devices, wherein the central computer performs the preparation of route into or out of marshaling yards based on the indications received from laser scanners and cameras screens; and laser scanners located parallel to the tracks in predefined locations so that laser scanners' beams cover the whole controlled area overlapping each other at switch points; and digital video cameras installed along the tracks to and from marshaling yard in different zones; and an automatically operated light emitting diode (LED) direction light element installed between tracks for visual indication to the driver along the route, wherein the direction light element provides the driver visual indication of track locking position and route direction.

2. The system of claim 1 wherein the cameras screens enable visual checks of cameras and laser scanners verifying that switch points are clear of any obstacle, movable object or human factor.

3. The system of claim 1 wherein the cameras screens provide indications of intention of movable objects to enter or exit of movable objects from the interlocking system.

4. The system of claim 1 wherein if any of the scanner indicates "in use position", the system offers a bypass mechanism in which it may enable preparation of the route only for a limited time by-passing the laser scanner alert.

5. The system of claim 1 wherein central computer performs the locking of route, so that switch points at control area are fixed and switch position may not be changed.

6. The system of claim 1 wherein when route is locked the direction light between tracks alight along the route indicating the position of the route and pointing out the direction of the trip to the train driver.

7. The system of claim 1 wherein when a movable object gets into or out of a marshaling yard all routes leading to movable object route show blocked route (red indication), all switch points on route to the track on which movable object is moving, are unmovable unless in emergency.

* * * * *